US011649621B2

(12) United States Patent
Stevens

(10) Patent No.: US 11,649,621 B2
(45) Date of Patent: May 16, 2023

(54) DRAIN STOPPER DEVICE

(71) Applicant: Andrew Stevens, Pearland, TX (US)

(72) Inventor: Andrew Stevens, Pearland, TX (US)

( * ) Notice: Subject to any disclaimer, the term of this patent is extended or adjusted under 35 U.S.C. 154(b) by 226 days.

(21) Appl. No.: 17/197,498

(22) Filed: Mar. 10, 2021

(65) Prior Publication Data

US 2021/0293011 A1 Sep. 23, 2021

Related U.S. Application Data

(60) Provisional application No. 62/990,595, filed on Mar. 17, 2020.

(51) Int. Cl.
*E03C 1/23* (2006.01)

(52) U.S. Cl.
CPC .... *E03C 1/2302* (2013.01); *E03C 2001/2317* (2013.01)

(58) Field of Classification Search
CPC ..... E03C 1/2302; E03C 2001/2317
USPC ..... 4/286–293, 295
See application file for complete search history.

(56) References Cited

U.S. PATENT DOCUMENTS 3,220,695 A * 11/1965 Jones ..... E03C 1/23 4/295
3,366,980 A * 2/1968 Forgie ..... E03C 1/23 4/295

* cited by examiner

*Primary Examiner* — Tuan N Nguyen
(74) *Attorney, Agent, or Firm* — Brennan, Manna & Diamond. LLC

(57) ABSTRACT

The present invention relates to plumbing fixtures, and more particularly to drain stopper assemblies used to control the flow of fluid through a drain opening of a sink or bathtub. More specifically, the present invention is a novel drain stopper device that can be attached or removed from a drain without the use of tools and without requiring a user to access the space underneath the drain. The device is preferably comprised of a drain stopper head portion having a repositionable push button in mechanical communication with a spring, a shaft and a pair of repositionable jaws such that the pair of jaws are repositioned to grip or release a pivot rod when the push button is repositioned between a first and a second position.

15 Claims, 4 Drawing Sheets

DRAIN STOPPER DEVICE

CROSS-REFERENCE TO RELATED APPLICATION

The present application claims priority to, and the benefit of, U.S. Provisional Application No. 62/990,595, which was filed on Mar. 17, 2020, and is incorporated herein by reference in its entirety.

FIELD OF THE INVENTION

The present invention relates to plumbing fixtures, and more particularly to drain stopper assemblies used to control the flow of fluid through a drain opening, such as a sink or bathtub drain. More specifically, the present invention relates to an improved drain stopper device that can be attached or removed from a drain without the use of tools and without requiring a user to access the space underneath the drain. The stopper device is comprised of a stopper head, a push button assembly, and a shaft, wherein the shaft is further connected to a set of spring-activated jaws that allow a user to clamp the stopper device around an existing drain pivot rod by pressing down on the push button assembly positioned on the stopper head. As a result, a user can easily attached/remove the stopper device from a position above the drain opening. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Drain stopper devices are commonly found in sinks, bathtubs, and the like, and allow a user to fill a sink or tub with water after lowering the stopper, which is typically controlled by a knob assembly on a faucet. The user can then empty the sink or tub by pulling the stopper or faucet knob upwards to raise the stopper device and allow for the water to empty via the drain as intended. Many existing drain stopper devices require the use of a pivot rod or other similar actuating device positioned below the stopper device that allows for the stopper device to be manually raised or lowered via a faucet knob that is in mechanical communication with the pivot rod. More specifically, many drain stopper devices are physically attached to a pivot rod that extends through by a continuous opening in a bracket that is connected to the actuating knob of a faucet, such as a sink or bathtub faucet. As such, both the pivot rod and the knob bracket are housed and must be attached to one another in the enclosed and cramped space below a sink, and potentially within a cabinet or a wall, both of which may make access difficult.

Accordingly, in the event of damage to a pivot rod or stopper assembly, an individual must bend or crawl underneath the sink to access the stopper assembly and pivot rod/bracket to restore function to the stopper assembly. As such, this process can be made extremely difficult due to factors such as the age and mobility of the individual attempting the repair, as well as the individual's size and whether the individual can physically fit under a sink and/or within an enclosed cabinet space below a sink. These problems are even further exasperated when the stopper assembly is positioned beneath a bathtub.

Additionally, the same issues typically arise when, for example, the drain becomes clogged with debris, hair, soap buildup and the like and must be cleaned. More specifically, in order to clean the clogged drain, the individual or a plumber must either access a cleanout (if one exists), or remove the drain assembly so that a snake or drain auger can be inserted down through the drain to clear the blockage.

Further, in order to repair a stopper assembly or clear a drain clog, the individual must possess a number of different plumbing tools and must have the physical dexterity, flexibility, knowledge and ability to reach all of the components of the stopper assembly in the space underneath a sink or bathtub. In addition, if a stopper assembly must be cleaned or replaced due to a clogged sink, the sink must be cleaned/flushed out before the stopper can be removed. Therefore, an individual must flush out the sink or tub prior to loosening and releasing the stopper from the drain. As such, access to the tools necessary for repairing a sink stopper as well as the knowledge and ability to perform plumbing repairs may be limited, thereby requiring that a professional be hired, which can be both time consuming and expensive.

Therefore, there is a long-felt need in the art for an improved drain stopper device that is self-contained such that an individual can easily remove the stopper device if, for example, the same becomes damaged or if the drain become clogged. Moreover, there is also a long-felt need in the art for an improved drain stopper device that is both repositionable within a drain and that is capable of being quickly and easily removed from a drain without requiring the user to gain access to or physically enter the space below the drain, which may be difficult. Further, there is a long-felt need in the art for an improved drain stopper device that does not require the use of any additional tools, plumbing or otherwise, or specialized plumbing knowledge to remove the drain stopper device from the drain. Finally, there is a long-felt need in the art for an improved drain stopper device that is relatively inexpensive to manufacture, and that is both safe and easy to use.

The present invention, in one exemplary embodiment, is comprised of an improved drain stopper device. The stopper device is comprised of a first end and a second end, wherein a generally disc-shaped stopper head having a puck button is positioned on the first end of the device. The stopper head is further connected to, or integrally formed with, an internal shaft, wherein the opposite end of the internal shaft extends to the second end of the stopper device. A set of spring-activated jaws is also positioned at the second end of the stopper. The jaws are mechanically linked to the push button positioned at the first end of the stopper device such that the jaws may be opened and closed by pushing and releasing the push button. More specifically, the jaws are used to attach the drain stopper device of the present invention to the pivot rod. Therefore, a user can easily and efficiently attach the improved drain stopper service to a pivot rod of a faucet assembly from above the drain, and without having to enter the space below the sink and/or bathtub.

In this manner, the novel and improved drain stopper device of the present invention accomplishes all of the forgoing objectives and provides a relatively safe, easy, convenient and cost-effective solution to allowing a user to easily replace a damaged drain stopper or temporarily remove the drain stopper so that the drain can be cleared of a clog or other obstruction via the drain directly, and without the need for the individual to access a cleanout. Further, the improved drain stopper of the present invention allows an individual to accomplish all of the forgoing without having to access the area underneath a sink or bathtub, which may be difficult to do for the reasons stated above. Finally, the unique design of the improved drain stopper device of the present invention does not require the use of any tools to install/remove beyond the stopper device itself, nor does it require any specialize knowledge to do so.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an improved drain stopper device. The stopper device is comprised of a first end having a generally a round or disc-like stopper head. The center of the stopper head is further comprised of a spring-activated push-button and rubber gasket seal, wherein the push button is attached to, or integrally formed with, a shaft assembly that is protected by an outer covering or housing. The stopper device is also comprised of a second end located at the bottom or opposite end of the shaft assembly (i.e., opposite the push button), wherein a set of spring-loaded jaws having a hinge pin are positioned and in mechanical communication with the second end of the shaft assembly. The presence of the hinge pin allows the set of jaws to open and/or close when a user presses or releases the push-button assembly of the stopper head. This opening and closing of the jaws allows the drain stopper device to attach/detach itself from a pivot rod positioned below a sink or bathtub.

As such, a user can easily and completely remove the stopper device from a sink or bathtub assembly from above the sink/bathtub by simply pressing the push button to open the jaw assembly and remove the stopper from the pivot rod. Further, this task can be accomplished without the need for additional tools or to access the area underneath the sink/bathtub to complete the removal or installation. In a further embodiment of the present invention, the shaft may be comprised of an internal spring, wherein the internal spring further connects the push button to the jaws such that the jaws can open/close upon the pressing/depressing of the push button and compression/decompression of the internal spring.

Accordingly, the novel drain stopper device of the present invention eliminates the need for a user to access the area underneath a sink or bathtub to remove or replace the drain stopper to, for example, clear a clogged drain. Therefore, the novel stopper device eliminates the hassle and discomfort associated with bending, stooping, or crawling under a sink or reaching under a bathtub, which may be extremely difficult for most individuals. In addition, the novel stopper device of the present invention alleviates the time and costs typically associated with standard drain stopper repairs or the replacement of drain stopper components by allowing the drain stopper to be attached/removed via the push of a button.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
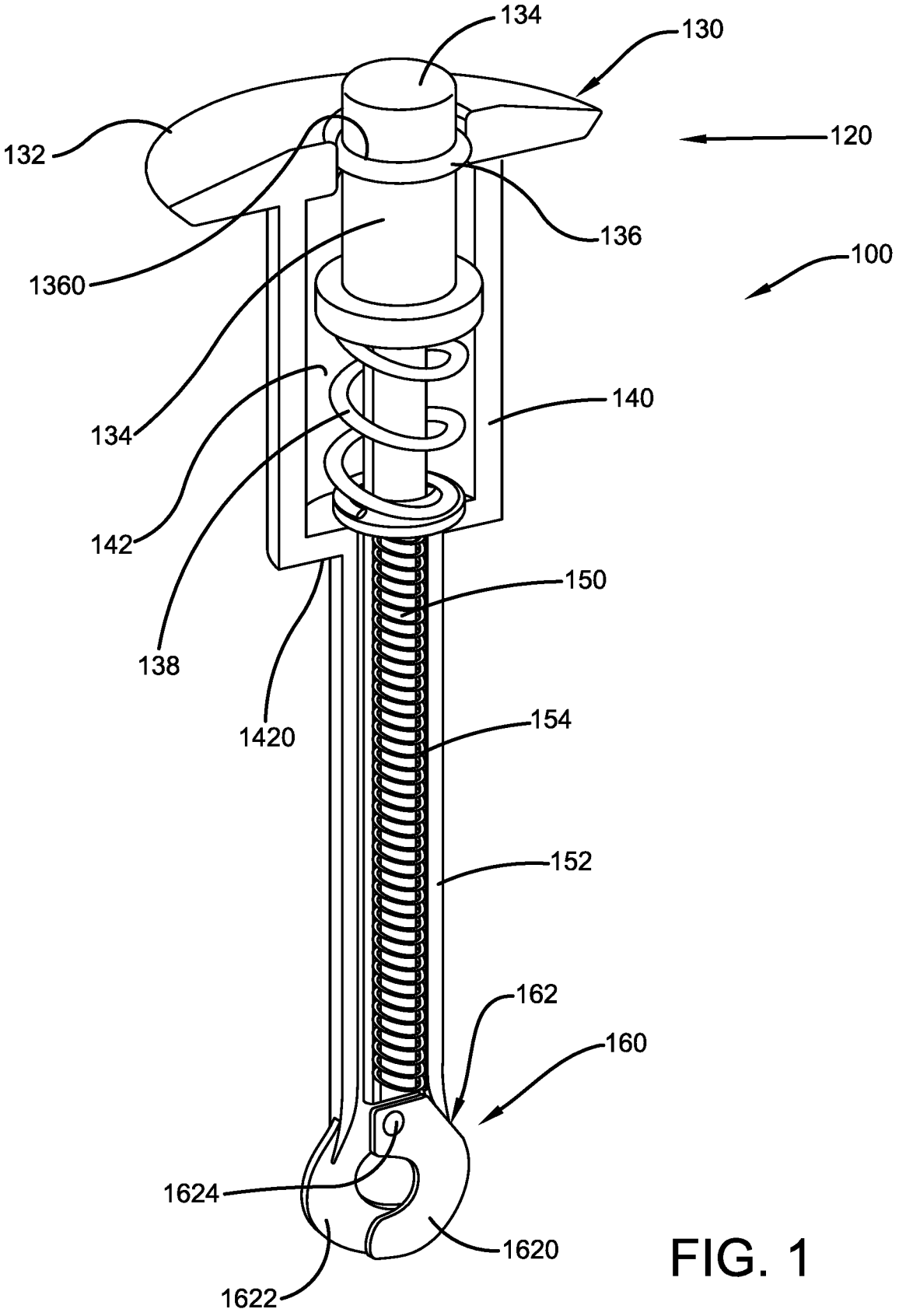
FIG. 1 illustrates a cutaway cross-sectional view of one potential embodiment of an improved drain stopper device of the present invention in accordance with the disclosed architecture, wherein the linkage between the push button and the repositionable jaws is fully displayed.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved and self-contained drain stopper device that is easily removable from an existing drain by an individual if, for example, the device becomes damaged or if the drain become clogged and requires cleaning. Moreover, there is also a long-felt need in the art for an improved drain stopper device that is both repositionable within a drain and that is capable of being quickly and easily removed from a drain without requiring the user to access/physically enter the space below the drain, which may be difficult to access. Further, there is a long-felt need in the art for an improved drain stopper device that does not require the use of any additional tools, plumbing or otherwise, or specialized plumbing knowledge to remove the drain stopper device from the drain. Finally, there is a long-felt need in the art for an improved drain stopper device that is relatively inexpensive to manufacture, and that is both safe and easy to use.

The subject matter disclosed and claimed herein, in one embodiment thereof, comprises an improved drain stopper device. The stopper device is comprised of a first end having a generally round/disc-like stopper head with a spring-activated push-button and rubber gasket seal, wherein the push button is in mechanical communication with a shaft and a set of spring loaded and repositionable jaws attached to a second opposing end of the shaft. More specifically, the jaws are attached to the shaft via a hinge pin that allows the jaws to open/close when a user presses or releases the push-button to allow the stopper device to attach/detach from a pivot rod below a sink of bathtub drain. As such, a user can easily and completely remove the stopper device from a drain assembly by simply depressing the push button to remove the stopper device jaws from around the pivot rod, and without the need for additional tools or to access the area underneath the sink to complete the removal.

Referring initially to the drawings, FIG. 1 illustrates a cutaway cross-sectional view of one potential embodiment of an improved drain stopper device 100 of the present invention in accordance with the disclosed architecture, wherein the linkage between the push button 134 and the repositionable jaws 162 is fully displayed. Generally stated, the improved stopper device 100 is comprised of a drain stopper head 130, a push button assembly 134, a shaft 150 and a repositionable jaw assembly 162. More specifically, the stopper device 100 is comprised of a first end 120 that is connected to a second end 160 by the shaft 150. The generally circular or disc-shaped stopper head 130 is positioned at the first end 120 of the stopper device 100, and is comprised of a top surface 132, an outer casing 140 and a continuous opening 142 that extends from the top surface in the direction of the second end 160. In differing embodiments of the stopper device 100 and unless otherwise stated herein, each of the components of the stopper device 100 may be comprised of a plurality of different materials such as, but not limited to a stainless steel, aluminum, plastic, or other durable and anti-corrosive materials.

Figure 3:
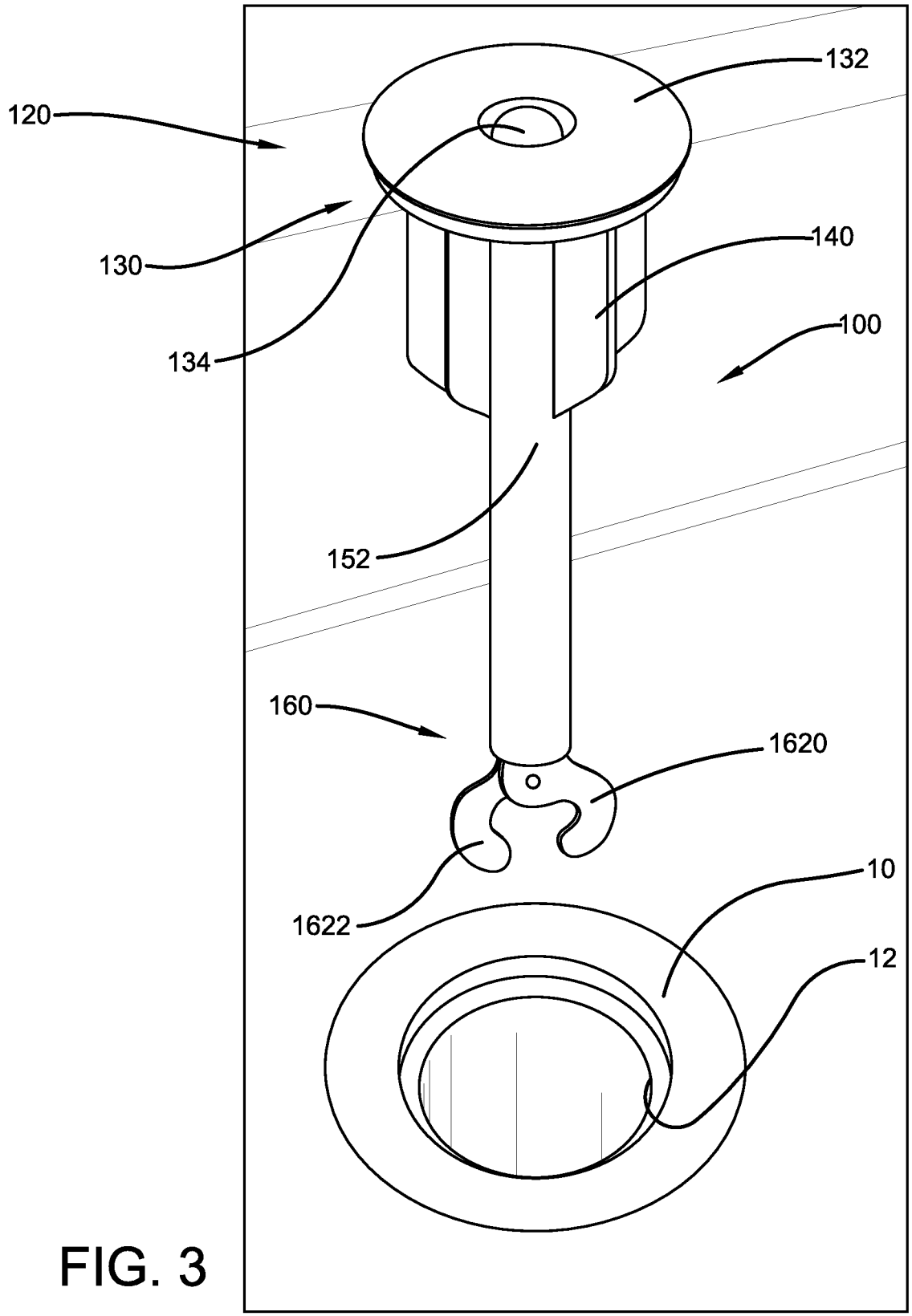
FIG. 3 illustrates a perspective view of one potential embodiment of the improved drain stopper of the present invention above a sink drain in accordance with the disclosed architecture.
Figure 4:
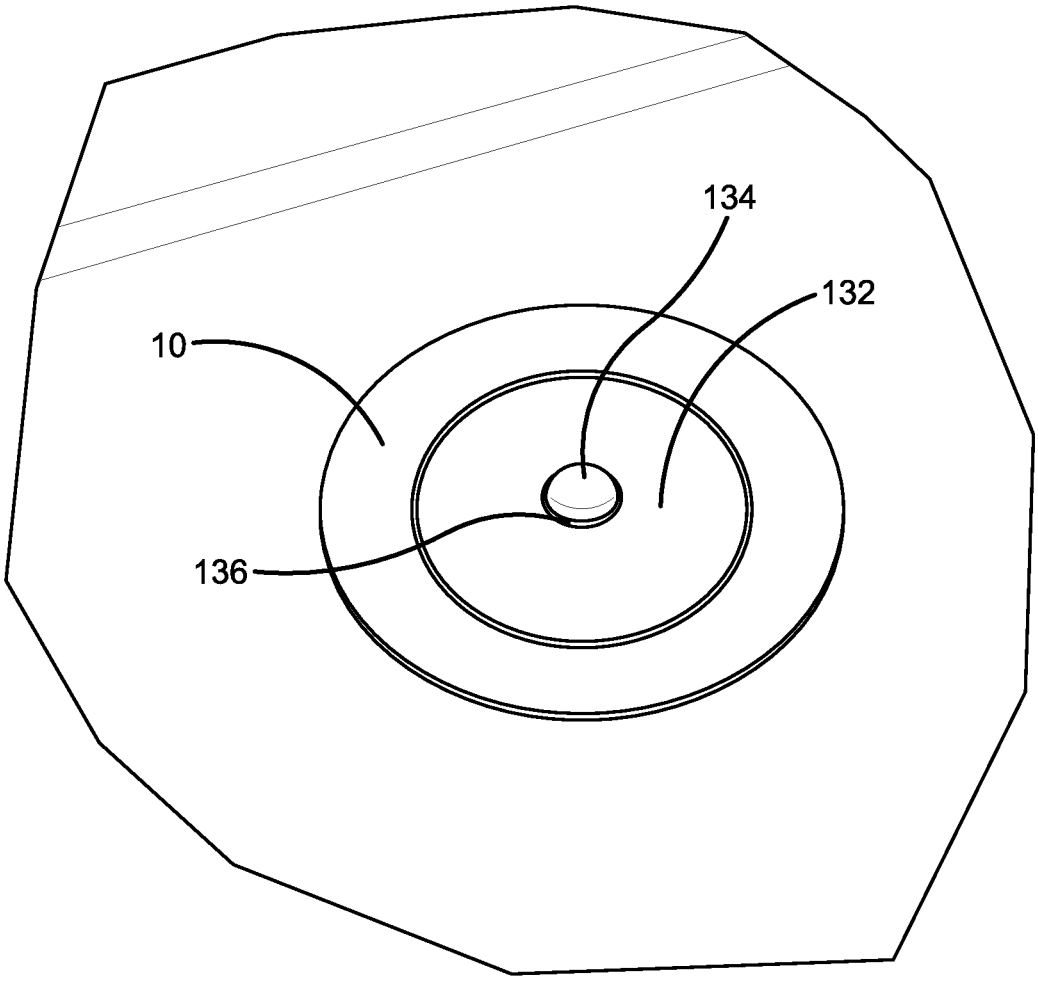
FIG. 4 illustrates a perspective view of one potential embodiment of an improved drain stopper device of the present invention installed in a drain in accordance with the disclosed architecture.

The center of the top surface 132 of the stopper head 130 is further comprised of a push button 134, which is repositionable between a first position (as best shown in FIG. 1) and a second position (as best shown in FIG. 3) within the continuous opening 142. The push button 134 is surrounded by a rubber gasket 136 that has a continuous opening 1360 therein, such that the gasket 136 is positioned completely around the push button 134 to ensure a water-tight seal with the interior walls of the stopper head 130 that form the opening 142 and to prevent water from entering into the opening 142 of the stopper head 132 (e.g., when the drain 10 is closed, as best shown in FIG. 4).

As best shown in FIG. 1, the portion of the push button 134 that sits below the gasket 136 is further housed with the opening and is in mechanical communication with a spring 138 (also positioned in the opening 142) that further connects the push button 134 to the shaft 150. When the push button 134 is in the first position (as best shown in FIG. 1), the spring 138 is in its natural uncompressed state and retains the push button 134 in the first position. By comparison, when a user (not shown) depresses the push button 134 in the direction of the second end 160 so as to place the push button 134 in the second position (as best shown in FIG. 3), the spring 138 will be placed in a compressed state, and the bias therein will cause the push button 134 to return to the first position when the user is no longer depressing the same.

Figure 2:
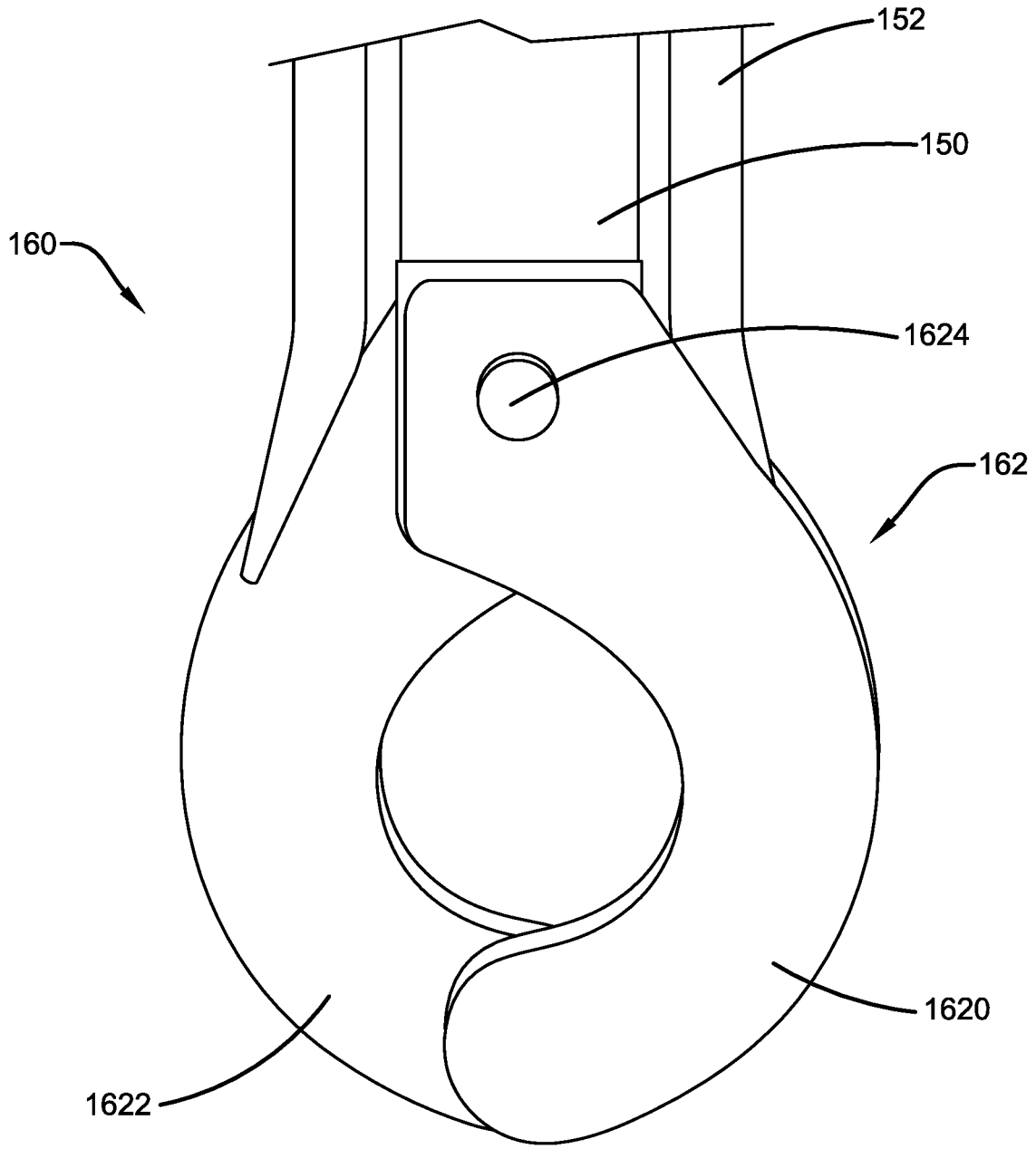
FIG. 2 illustrates a cutaway cross-sectional view of one potential embodiment of the jaw assembly of the improved drain stopper device of the present invention in accordance with the disclosed architecture.

FIG. 2 illustrates a cutaway cross-sectional view of one potential embodiment of the jaw assembly 162 of the improved drain stopper device 100 of the present invention in accordance with the disclosed architecture. More specifically, the jaw assembly 162 is positioned on the second end 160 of the stopper device 100, and is attached to, or is in mechanical communication with, the shaft 150. The jaw assembly 162 is comprised of a curved first jaw 1620, a curved second jaw 1622, a hinged pivot or pin 1624, and a continuous opening 1626 positioned between the first jaw 1620 and the second jaw 1622 for receipt of pivot rod 14. By way of background, the pivot rod 14 is in mechanical communication with a handle or other actuation device (not shown) and is known in the art, and that enables a user to reposition the stopper device 100 within the drain opening 12 to close or open the drain 10 as desired to, for example, allow the sink or bathtub basin to fill with water (e.g., if the drain opening 12 is closed), or drain the water that exists in the sink or bathtub basin if the drain opening 12 is open.

Each of the first and second jaws 1620, 1622 are linked together via a hinge/pivot pin 1624 that allows the first and second jaws 1620, 1622 to reposition from a closed position (as best shown in FIGS. 1 and 2) to an open position (as best shown in FIG. 3). More specifically, when the push button 134 is depressed into the second position (see FIG. 3), the spring 138 presses down against the bottom surface 1420 of the cavity 142 and the shaft 150 to allow the repositionable first and second jaws 1620, 1622 to pivot about the pin 1624 and separate slightly to form gap 1628 (see FIG. 3) so that the jaws 1620, 1622 can accept pivot rod 14 into the opening 1626. Once the pivot rod 14 is positioned within the opening 1626 and is mechanically connected to the stopper device 100 such that the operation of the pivot rod 14 causes the stopper device 100 to reposition within the drain opening 12, the push button 134 is released and the bias in the spring 138 causes the push button 134 to return to the first position (see FIG. 1) and the first and second jaws 1620, 1622 to close around the pivot rod 14 such that the gap 1628 will be eliminated.

Therefore, a user need not crawl underneath the sink area to detach/attached the stopper device 100 from the pivot rod 14, as is required with existing drain stopper devices. Notwithstanding, it should be noted that in alternative embodiments of the stopper 100, the pivot pin 1624 may be connected to a spring 154 that is located within an interior of the shaft 150 such that the spring 154 is connected to the lower portion of the push button 1342 which can then allow the jaw assembly 162 to open and close as described. Further, in differing embodiments of the stopper device 100, the shaft 150 may be further comprised of an internal spring 154 that connects to the pin 1624 to allow the jaw assembly 162 to open/close upon the pressing/depressing of the push button 134.

FIG. 3 illustrates a perspective view of one potential embodiment of the improved drain stopper 100 of the present invention above a sink drain 10 having a drain opening 12 therein in accordance with the disclosed architecture. More specifically, the shaft 150 may be comprised of a waterproof, rigid, protective cover 152 that protects the same from soap buildup, grime, hair and other debris that may pass down the drain opening 12. Similarly, and as mentioned above, the stopper head 130 may be comprised of a waterproof, rigid, protective outer casing 140 that protects the opening 142 and its components from the same soap buildup, grime, hair and other debris that may pass down the drain opening 12. The width or diameter of both the outer casing 140 and the protective cover 152 must be less than the width or diameter of the drain opening 12 to allow the sink or tub basin to properly drain and, as best shown in FIGS. 1-3, the width or diameter of the protective cover 152 is substantially less than the width or diameter of the outer casing 140.

FIG. 4 illustrates a perspective view of one potential embodiment of an improved drain stopper device 100 of the present invention installed in a drain 10 in accordance with the disclosed architecture. As stated above, to install the stopper device 100 and attach the same to the pivot rod 14, the user would simply insert the stopper device 100 into the drain opening 12 until the closed jaw assembly 162 is resting on the pivot rod 14. The user would then depress the push button 134 to overcome the bias in the spring 138 and put the push button in the second position, which in turn causes the first and second jaws 1620, 1622 to pivot about the pin 1624 and separate slightly to form gap 1628 (see FIG. 3) so that the jaws 1620, 1622 can accept pivot rod 14 into the opening 1626. Once the pivot rod 14 is positioned within the opening 1626 and is mechanically connected to the stopper device 100 (i.e., such that the operation of the pivot rod 14 causes the stopper device 100 to reposition within the drain opening 12), the push button 134 is released and the bias in the spring 138 causes the push button 134 to return to the first position (see FIG. 1) and the first and second jaws 1620, 1622 to close around the pivot rod 14 such that the gap 1628 will be eliminated.

Similarly, when a user desires to remove the stopper device 100 from the drain opening 12 to, for example, remove a damaged stopper device 100 or unclog the drain opening 12, the user would again simply depress the push button 134 to cause the first and second jaws 1620, 1622 to pivot about the pin 1624 and separate slightly to form gap 1628 (see FIG. 3) so that the jaws 1620, 1622 can release the pivot rod 14 from the opening 1626 via the gap 1628.

Notwithstanding the foregoing, the improved stopper device 100 of the present invention and its various components can be of any suitable size and configuration as is known in the art without affecting the overall concept of the invention, provided that they accomplish the above stated objectives. One of ordinary skill in the art will appreciate that the size, configuration, and material of the improved drain stopper device 100 and its various components as shown in the FIGS. are for illustrative purposes only, and that other configurations of the improved drain stopper device 100 are well within the scope of the present disclosure.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An improved drain stopper device comprising:
a drain stopper head;
a push button;
a shaft; and
a repositionable jaw assembly, wherein the repositionable jaw assembly comprises a first jaw, a second jaw, an opening between the first and second jaws, and a hinge pin and further wherein each of the first and second jaws are in mechanical communication with the push button and rotate about the hinge pin.

2. The improved drain stopper device as recited in claim 1, wherein the push button is repositionable between a first position and a second position, and further wherein a gap exists between the first jaw and the second jaw when the push button is in the first position and the gap does not exist when the push button is in the second position.

3. The improved drain stopper device as recited in claim 2 further comprising a spring.

4. The improved drain stopper device as recited in claim 3 further comprising a gasket.

5. The improved drain stopper device as recited in claim 4, wherein the push button is centered along a top surface of the drain stopper head.

6. The improved drain stopper device as recited in claim 5 further comprising a protective cover, wherein the shaft is positioned within the protective cover.

7. The improved drain stopper device as recited in claim 6 further comprising an outer casing.

8. The improved drain stopper device as recited in claim 7, wherein a width of the outer casing is larger than a width of the protective cover.

9. An improved drain stopper device comprising:
a circular drain stopper head integrally formed with an outer casing and having a continuous opening therein;
a push button at least partially positioned in the continuous opening;
a shaft at least partially positioned in the continuous opening, wherein the circular drain stopper head is positioned on a first end of the shaft; and
a repositionable jaw assembly positioned on a second end of the shaft, wherein the repositionable jaw assembly comprises a first jaw, a second jaw, an opening between the first and second jaws, and a hinge pin and further wherein each of the first and second jaws are in mechanical communication with the push button and rotate about the hinge pin.

10. The improved drain stopper device as recited in claim 9, wherein the push button is repositionable between a first position and a second position, and further wherein a gap exists between the first jaw and the second jaw when the push button is in the first position and the gap does not exist when the push button is in the second position.

11. The improved drain stopper device as recited in claim 10 further comprising a spring.

12. The improved drain stopper device as recited in claim 11 further comprising a gasket.

13. The improved drain stopper device as recited in claim 12 further comprising a protective cover, wherein the shaft is positioned at least partially within the protective cover.

14. The improved drain stopper device as recited in claim 13, wherein a width of the outer casing is larger than a width of the protective cover.

15. An improved drain stopper device comprising:
a drain stopper head attached to an outer casing;
a push button positioned along a top surface of the drain stopper head and repositionable between a first position and a second position;

a spring in mechanical communication with the push button, wherein the spring is at least partially compressed when the push button is in the second position;

a shaft, wherein the drain stopper head is positioned on a first end of the shaft; and a repositionable jaw assembly positioned on a second end of the shaft, wherein the repositionable jaw assembly comprises a first jaw, a second jaw, an opening between the first and second jaws, and a hinge pin, and further wherein each of the first and second jaws are in mechanical communication with the push button and rotate about the hinge pin, and yet further wherein a gag exists between the first jaw and the second jaw when the push button is in the second position and the gap does not exist when the push button is in the first position.

* * * * *